US006152443A

United States Patent [19]

Claramunt et al.

[11] Patent Number: 6,152,443

[45] Date of Patent: Nov. 28, 2000

[54] OPTICAL DEVICE FOR DETECTING THE PRINTING MEDIA IN PRINTERS

[75] Inventors: David Claramunt; Luis Hierro, both of Barcelona, Spain

[73] Assignee: Hewlett-Packard Company, Fort Collins, Colo.

[21] Appl. No.: 09/143,181

[22] Filed: Aug. 28, 1998

[30] Foreign Application Priority Data

Sep. 2, 1997 [EP] European Pat. Off. ..... 97500151

[51] Int. Cl.[7] ..... B65H 7/02; B65H 83/00; B65H 1/18; H01J 40/14; S01D 5/36

[52] U.S. Cl. ..... 271/258.05; 271/3.17; 271/152; 250/214 PR; 250/232; 250/559.4

[58] Field of Search ..... 250/214 PR, 232, 250/233, 559.4; 271/3.15, 3.17, 227, 258.01, 262, 263, 258.05, 265.04, 152

[56] References Cited

U.S. PATENT DOCUMENTS

| | | | |
|---|---|---|---|
| 4,791,457 | 12/1988 | Shida . | |
| 5,042,790 | 8/1991 | Miller et al. | 271/110 |
| 5,329,119 | 7/1994 | Swartz et al. . | |
| 5,539,510 | 7/1996 | Yamashiro et al. . | |
| 5,634,635 | 6/1997 | Kobayashi et al. | 271/3.16 |
| 5,915,690 | 6/1999 | Surya | 271/265.01 |

FOREIGN PATENT DOCUMENTS 2299070A 1/1995 United Kingdom .

OTHER PUBLICATIONS

European Search Report, EP 97 50 0151, Jan. 27, 1998.
Patent Abstracts of Japan, vol. 008, No. 253, Nov. 20, 1984.
Abstract, XS MA 9750015110.

*Primary Examiner*—Donald P. Walsh
*Assistant Examiner*—Brett C. Martin

[57] ABSTRACT

An optical device for detecting the printing media in printers includes an element pivoting on two rotation pivots which are incorporated therein a certain distance apart and which are guided in respective independent curved grooves. The pivoting element includes two extensions which point outwards from the central portion of the element, and of which one is intended to receive, at its front and rear edges, the end edges of the laminar printing media during its forward and rearward movements towards and away from the input rollers of the laminar substrate in the printer. The second extension of the pivoting element can move into and out of an opening of the optical detector in a manner corresponding to the rotary movements of the pivoting element brought about by the movements of the printing media. The pivoting element of the detector is located in a position such that the extension on which the printing media is intended to act establishes contact with the face of the printing media opposite to that which receives the printing.

15 Claims, 5 Drawing Sheets

OPTICAL DEVICE FOR DETECTING THE PRINTING MEDIA IN PRINTERS

FIELD OF THE INVENTION

The present invention relates to an optical device for detecting the presence of media, which can be used in several hard copy devices, such as for instance copiers, scanners, facsimile machines, or printers of various types, bringing characteristics of novelty and inventive activity with respect to the prior art.

BACKGROUND OF THE INVENTION

The present invention is applicable in particular, to large-format printers, also known as "plotters", which are intended, in particular, for printing on continuous or sheet-like printing media usually printing paper. These printers are computer-controlled and print on a printing media which is moved through the printer, being acted on by an ink-jet printing cartridge which moves transversely relative to the movement of the printing media.

Printers of this type incorporate detectors for detecting the passage of the printing media in order to obtain therefrom a signal which indicates the presence or absence of the printing media, this signal being used by the printer for many processes in accordance with the programs stored in the electronic control unit of the printer.

Currently, printers which have a detector situated at the input for the printing media on its path towards paper-feed rollers which transport it along its path through the printer are known, the substrate normally being paper either in roll form, that is, continuous paper, or in sheet form. The currently-known devices for detecting the presence of the printing media are mounted in the lower portion of the paper input, that is, the portion which corresponds to the paper-input platen, and have a detector lever which points upwards and can pivot on an intermediate pivot pin upon the passage of the front edge of paper coming from the roll incorporated in the printer itself, or of separately-fed sheets. This system has certain disadvantages, amongst which may be cited: the fact that the lever for detecting the presence of the sheet of paper is affected by oscillations and takes a certain time to stop again owing to natural damping after it has been inclined by the action of the edge of the paper or of the sheet of paper. This is a source of delays in the processes for interpreting the signal in th,e printer and therefore of delay in the processes generated on the basis of the said detection.

Another disadvantage is that, when these printers operate in a manner such that the sheet or roll of paper is guided towards the interior of the printer, being guided around a main roller and passing towards the rear, towards the print region forming, as a whole, a U-shaped loop, the end of the pivoting lever of the paper detector contacts the face which will subsequently receive the printing, which is inadvisable since, in certain cases, the contact of the lever may produce marks on the paper which impair the printing carried out or even render it unusable.

SUMMARY OF THE INVENTION

The present invention is intended to solve the problems of the prior art, disclosing means for ensuring that the printing-media detection lever does not suffer oscillations at the moment when it regains its position after the passage of the rear edge of the sheet of paper or of a portion of the roll, preventing the problems brought about by the delay generated by the said oscillation.

At the same time, the present invention provides for means for detecting the presence of the sheet of paper, the means being disposed above the paper support in the region in which the paper enters the machine, so that the detector lever acts on the rear face of the printing media and there will therefore be no adverse effect on the face which is subject to printing, as is the case at the moment.

To achieve its objects in order for the pivoting lever for detecting the presence of the printing media to regain its rest position after its operation without oscillations, the present invention provides for the creation of a pivoting element which is intended to detect the presence of the sheet of paper and is guided by two pivots rotatable in respective arcuate grooves arranged symmetrically relative to one another and terminating at a common point, in a manner such that each of the two guide grooves coincides with an arc of a circle described from each of the two pivots of the pivoting element when they are in the rest position. Moreover, the body of the said pivoting element has the two pivots in the vicinity of its upper edge, a first, lower extension extending from the pivoting element in order to interfere with the path of the edge of the laminar printing media and the body having a second, lateral extension which is intended to coincide with the path of the control light-beam. With this arrangement, the centre of gravity of the pivoting element is disposed below both pivots in the rest position so that, when the said pivoting element regains the initial rest position, its position is determined by the pivoting element contacting the base of the curved groove by means of the pivot which is moving along the same. The pivoting element thus takes up its rest position without oscillation at the end of its travel.

BRIEF DESCRIPTION OF THE DRAWINGS

For a better understanding, a set of drawings corresponding to a preferred embodiment of the present invention is appended, by way of non-limiting example.

DETAILED DESCRIPTION OF THE INVENTION

Figure 1:
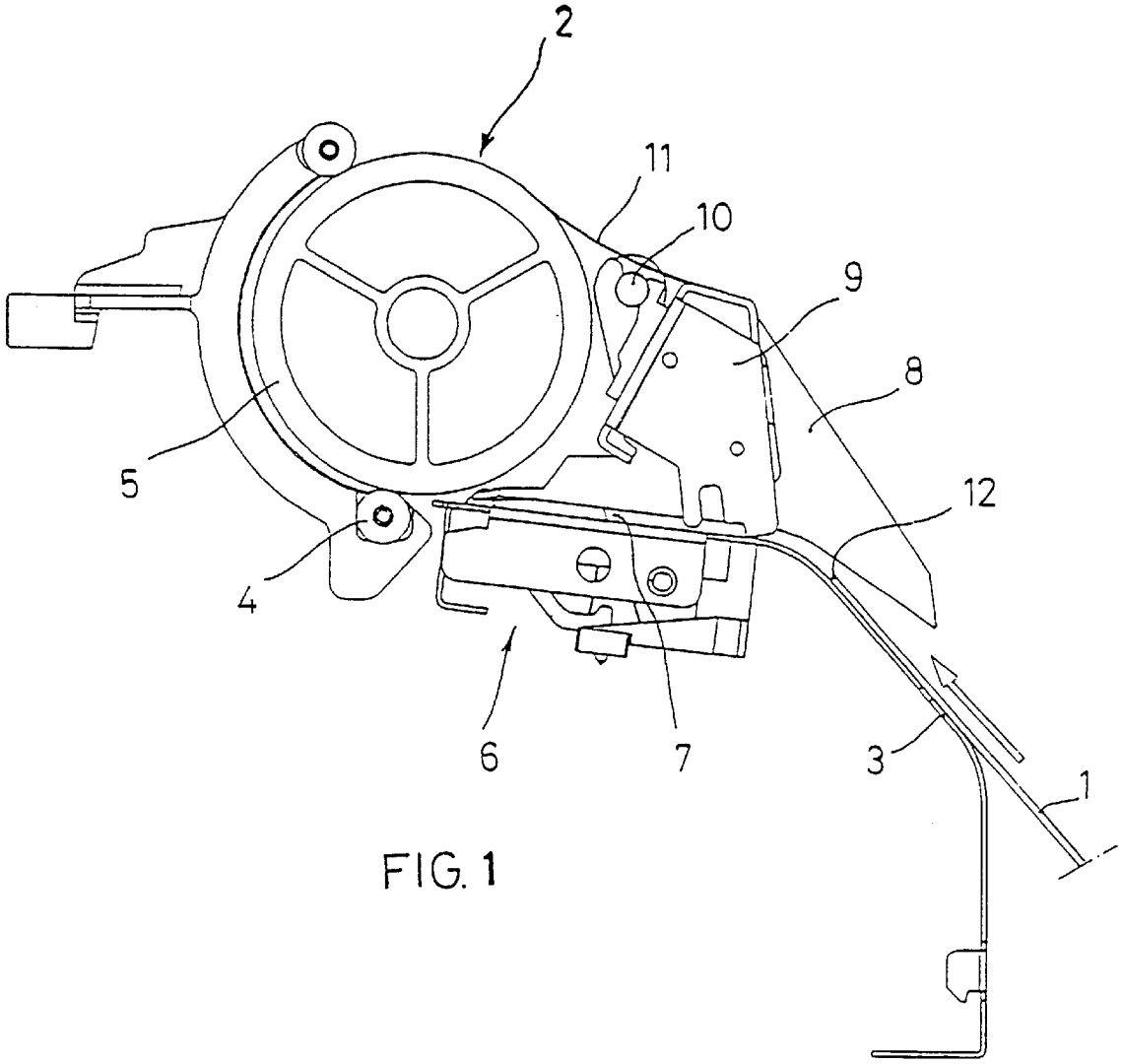
FIG. 1 is a simplified cross-section which shows the guide plate for the input of the printing media, the printing-media detector, and the feed and guide rollers in a conventional printer.

As will be appreciated from FIG. 1, in a currently-known printer, the printing media, in the form of paper 1 in roll or sheet form, is supplied to the entrainment and guide head 2 of the printer, sliding over the support platen 3 and passing to the entrainment roller 4, which grips the printing media, together with the main cylinder 5, the substrate passing in front of the printing-media detection device 6 which has the pivoting lever 7 on the path of the paper, the said lever acting on the lower face of the printing media 1 with reference to the position of the paper shown in the drawing. The printing media 1 is protected from above by the front guide structure 8 for guiding the printing media on its descent and by the support 9 of the upper guide roller 10.

This arrangement has the disadvantages explained above that the pivoting lever 7 oscillates and that the end of the pivoting lever acts on the lower face of the printing media 1 which, after passing over the main cylinder 5, will be disposed on the paper separator 11 so that the lower face of the printing media, with reference to the position of the said printing media at the input to the printer, will have become the upper face at the output of the printer, so that the printing will have taken place precisely on the said face, showing any marks which may have been produced by the end of the lever.

Moreover, in the known structure shown in FIG. 1, the guide unit 8 and the structure 9 together obstruct the view of the upper end 12 of the printing media supplied to the printer, especially when the said printing media is in the vicinity of the gripping region between the rollers 4 and 5, that is, upon reaching the end of the initial, manual-feed period.

Figure 2:
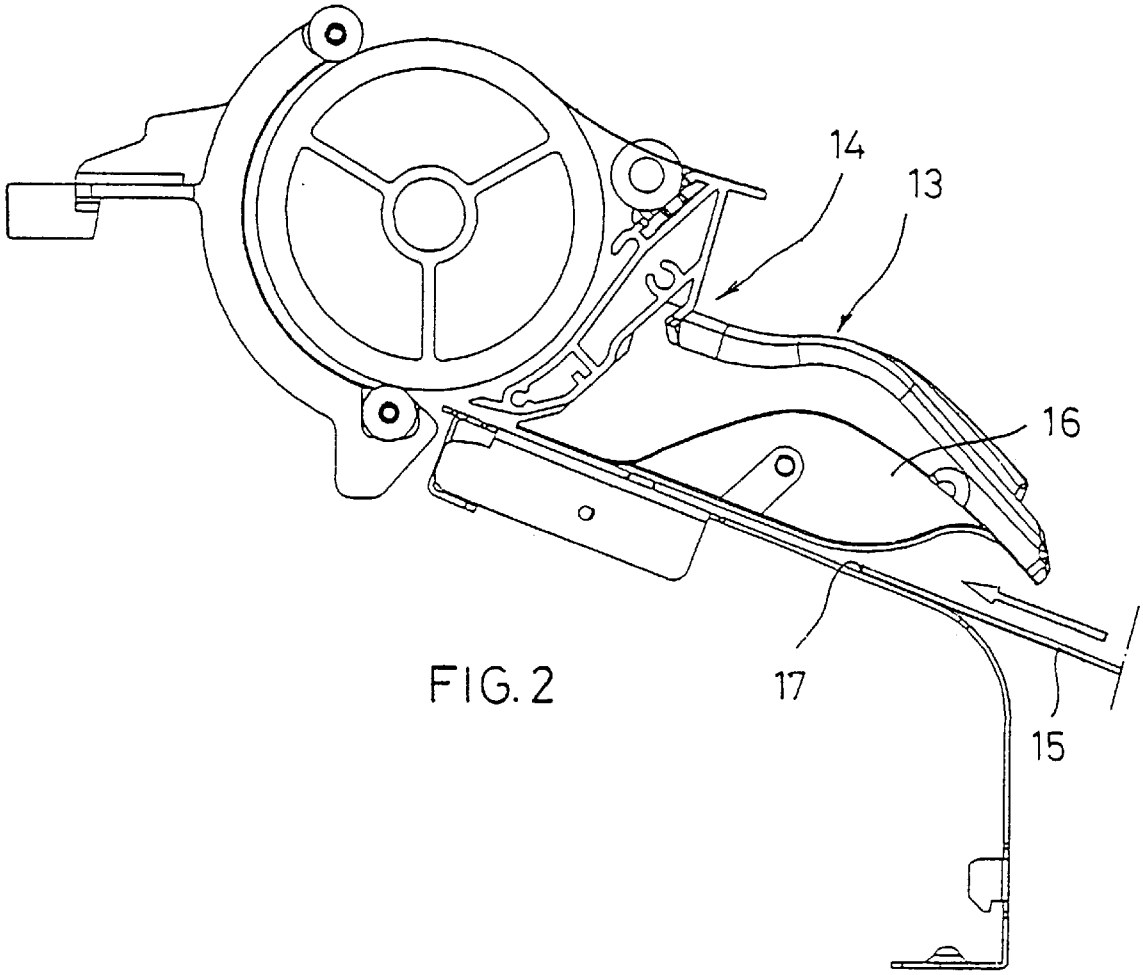
FIG. 2 is a sectioned view equivalent to FIG. 1 showing a printer incorporating the present invention.
Figure 3:
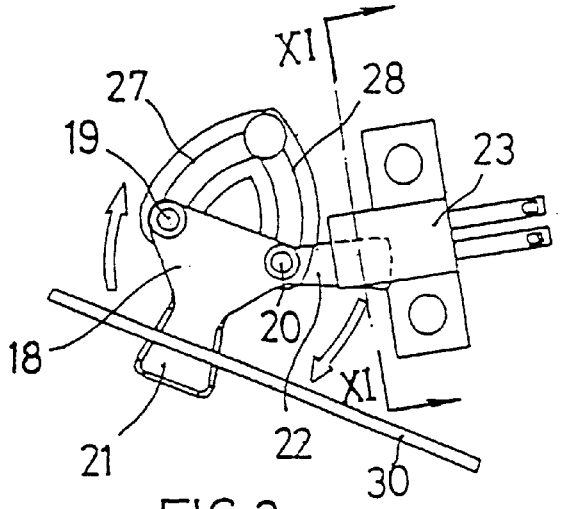
FIGS. 3 to 10 are schematic side elevational views showing the pivoting element of a device for detecting the laminar printing media of a printer in accordance with the present invention.
Figure 4:
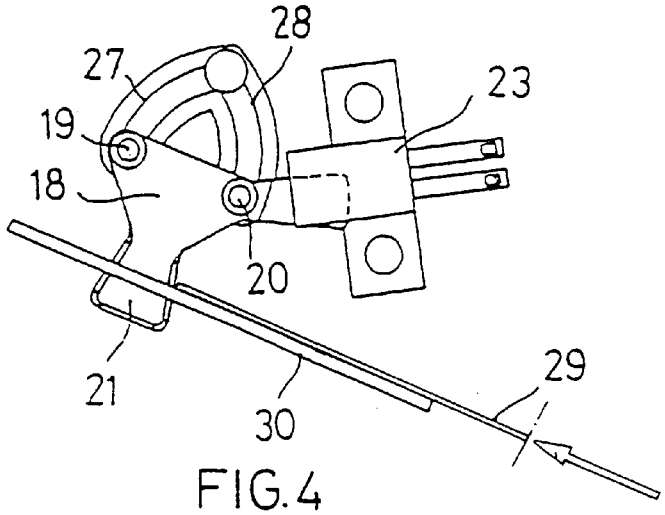

In the arrangement shown in FIG. 2, the front structure 8 and 9 which covers the entire width of the printer has been replaced by a series of deflecting elements 13 of limited width which therefore enable the location of the printing media 15 to be seen up to the region 14. In this version, the printing-media detector is disposed in the region 16 corresponding to the lower portion of the deflecting element 13, thus enabling the lever which is acted on by the edge 17 or the printing media 15 to act downwards from above, thus acting on the opposite face to the printing face, that is, in the opposite manner to that which occurs in the previously known arrangement shown in FIG. 1. Any possible stains on the printed face of the printing media are thus prevented.

In accordance with the present invention, the printing-media detector is made up as can be seen in greater detail in the embodiment shown in FIGS. 3 to 10.

Figure 11:
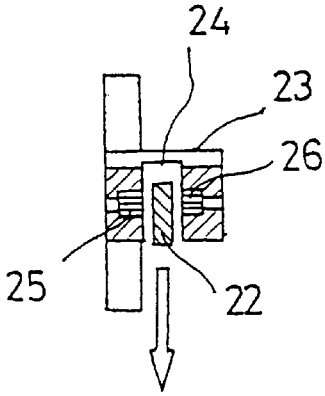
FIG. 11 shows a cross-section taken in the section plane indicated in FIG. 3.

In accordance with the present invention, a pivoting element 18 is formed, which preferably has a flattened structure and opposite edges, and which also has two rotation pivots 19 and 20 separated by a certain distance, the said pivoting element 18 being completed by two extensions, a lower extension 21 for receiving the edge of the printing media, and another, lateral extension 22 for introduction into the support 23 carrying the conventional means for generating and receiving the light beam which, upon interruption by the said extension 22, generates the desired control signal relating to the presence or absence of the printing media. As shown schematically in FIG. 11, the support 23 has an internal slit 24 which is penetrated by the extension 22, and which has, on its faces, the conventional elements indicated schematically by the numerals 25 and 26, for generating and receiving a light beam which may be interrupted by the extension. 22.

The pivots 19 and 20 of the element 18 slide in respective grooves 27 and 28 shaped as arcs of circles, each of which has its centre of rotation at the lower end of the other groove, defining respective upper and lower limit stops for the rotation pivots. As will be appreciated from FIG. 3, the arcuate groove 28 has its centre of rotation at the lower end of the groove 27 at which the pivot 19 is disposed in the rest position and, conversely, the groove 27 along which the pivot 19 moves has its centre at the lower end of the groove 28 at which the pivot 20 is disposed in the rest position.

Figure 5:
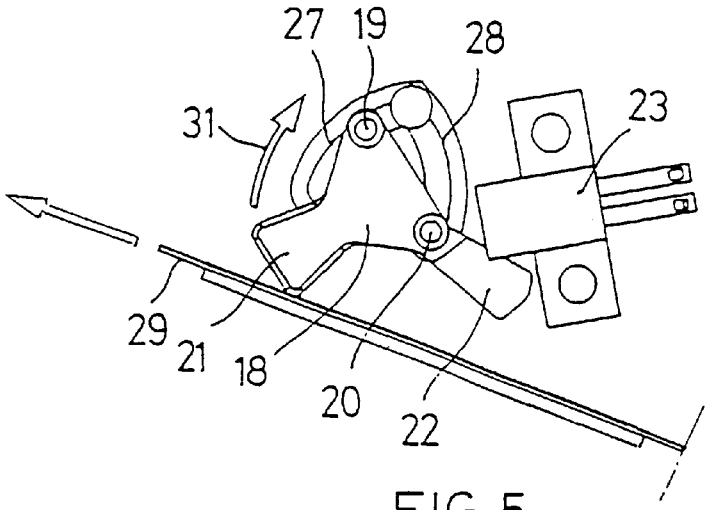
Figure 6:
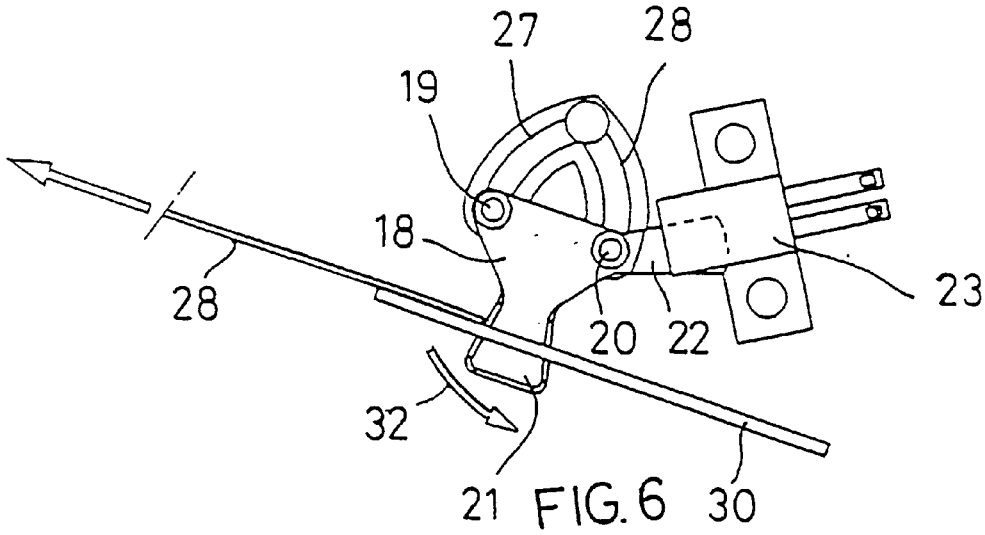
Figure 7:
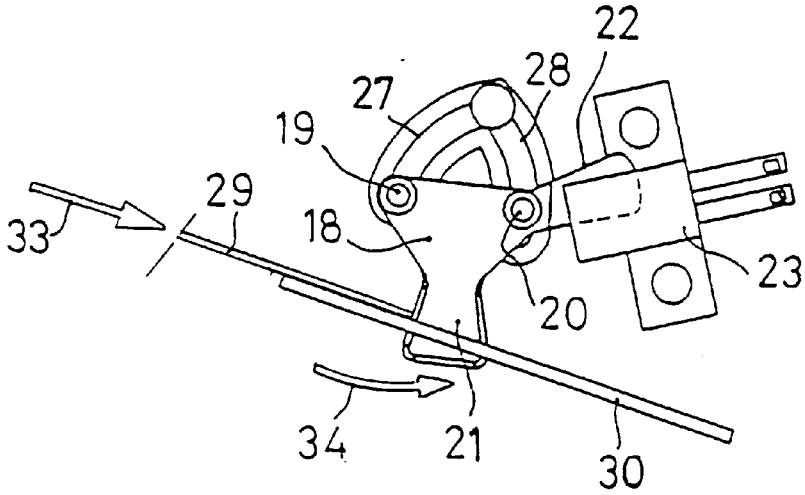
Figure 8:
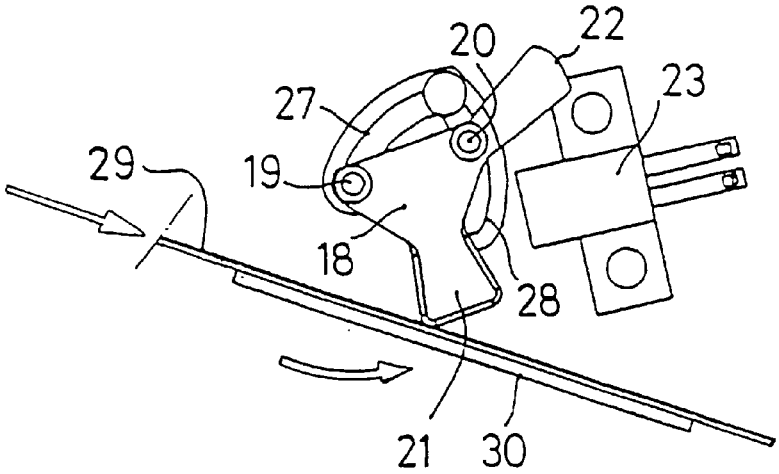
Figure 9:
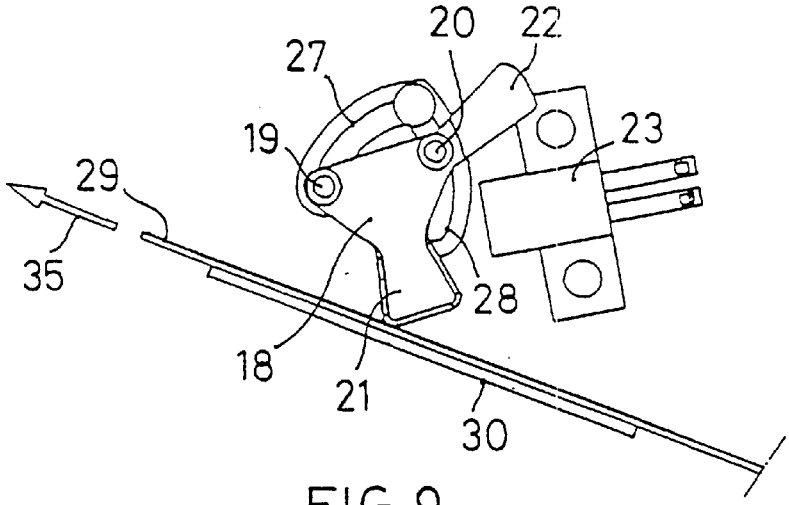

By virtue of this arrangement when the printing media 29 in the form of continuous paper, a sheet of paper or the like is introduced it slides over the platen 30, its front edge falling on one of the side edges of the extension 21, which acts as a pivoting lever so that the pivoting element 18 as a whole rotates in accordance with the arrow 31 indicated in FIG. 5, the extension 22 coming out of the support 23 and the printing media 29 sliding towards the feed roller of the printer. As can be seen in FIG. 5, the pivot 19 has slid inside the groove 27 rising along it, whilst the pivot 20 has remained in its rest position bearing on the lowest portion of the groove 28. Once the whole of the laminar substrate 29 has passed under the pivoting element 18, the latter returns to its rest position as shown in FIG. 6, owing to the effect of gravity, pivoting on the pivot 20, and rotating in accordance with the arrow 32. In this position, the extension 22 has been introduced into the support 23 again, interrupting the beam once more.

According to one of the characteristics of the present invention, and as has been established by the inventors, given the structure of the pivoting element 18 combined with the two grooves shaped as arcs of circles, during the return movement of the pivoting element back to the rest position, the element is well centered between the two supports which act as stops during the vertical movement of the pivoting element 18 so that, in combination with the considerably lower position of the centre of gravity of the said element 18 in comparison with the pivot points, a positioning of the pivoting lever to its rest position is brought about without appreciable oscillation thereof, preventing the oscillation effect of the levers of the currently-known optical detectors.

Figure 10:
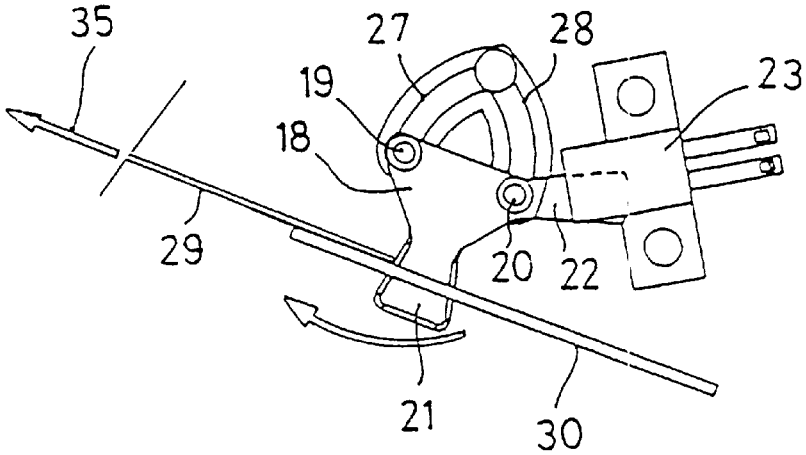

FIGS. 7 to 10 show the various movements of the pivoting element according to the modality of use of the printer. Thus, for example, in FIG. 7, it can be seen that the printing media 29, which is moving rearwardly, as indicated by the arrow 33, returns to lift the pivoting element 18, the extension 22 coming out of the support 23 again until it reaches the position shown in FIG. 8, the pivoting element 18 rotating anticlockwise in accordance with the arrow 34. The laminar substrate 29 is shown moving forwards again in FIG. 9, in which the opposite movement of the paper, indicated by the arrow 35, can be seen, the pivoting element 18 remaining in the same raised position as in FIG. 8, having rotated on the pivot 19 which is situated in the lower position, and the pivot 20 having moved along the groove 28. When, in its upward movement in accordance with the arrow 35, the lower edge of the printing media 29 has passed beyond the rest position of the pivoting element 18, the said pivoting element 18 returns to its rest position as shown in FIG. 10, operating in the same manner as explained above so that any oscillations in the pivoting lever are prevented.

Owing to the specific construction of the detector of the present invention, as indicated, a very marked self-stabilizing effect is achieved, preventing oscillations of its operating lever when the element returns to its rest position. Moreover, the advantage is achieved, that the action of the lever takes place on the opposite face of the printing media to the printing face and the sensor as a whole has greatly reduced friction and bi-directional operation, that is, the detector is active for both directions of movement of the printing media.

Although the invention has been described with reference to the embodiment shown in the above-mentioned drawings, it will be understood that it is not limited to this embodiment but, on the contrary, may adopt many variations which will be clear to experts in the art and are included within the scope of the following claims.

What is claimed is:

1. An optical device for detecting an edge of a medium in hard copy devices, comprising an extension which engages the medium and oscillates simultaneously on two pivots, each of which engages a respective guiding groove.

2. An optical device as claimed in claim 1, which comprises an optical sensor and a pivoting element pivoting on the two rotation pivots which are incorporated therein a certain distance apart, wherein said guiding grooves are shaped as independent and curved, said pivoting element comprising said first extension of the optical device and a second extension; the first extension engaging, at its front and rear edges, the edges of the medium during forward and rearward movements of the medium; the second extension moving into and out of an opening of the optical sensor in a manner corresponding to the rotary movements of the pivoting element brought about by the movements of the medium.

3. An optical device as claimed in claim 1, wherein the first extension has a flattened structure defining opposite edges.

4. An optical device as claimed in claim 2, wherein the centroid of the pivoting element: is disposed below the line joining its two rotation pivots, bringing about a self-centring effect of the rotation pivots on the lower ends of the respective grooves.

5. An optical device as claimed in claim 1 wherein the grooves are shaped as arcs of circles and disposed in opposition to one another, each of them defining an upper and a lower travel limit for their respective rotation pivot.

6. An optical device as claimed in claim 5, wherein the geometrical centre of each of the grooves is disposed at the lower end of the opposite groove.

7. A hard copy device comprising an input guide for media and an optical device for detecting an edge of a medium arranged above the input guide, whereby a first extension of the optical device contacts the medium, extends downward towards said input guide and oscillates simultaneously on two pivots.

8. The hard copy device as claimed in claim 7, which further comprises a front element for deflecting the media when it is output from the hard copy device, wherein such front element incorporates said optical device.

9. The hard copy device as claimed in claim 7, wherein the first extension of the optical device engages the medium on the face which is opposed to the one intended to receive the printing.

10. The hard copy device as claimed in claim 7, wherein each of said two pivots engages a respective guiding groove.

11. The hard copy device as claimed in claim 7, wherein the optical device comprises an optical sensor and a pivoting element pivoting on the two rotation pivots which are incorporated therein a certain distance apart, wherein said guiding grooves are shaped as independent and curved, said pivoting element comprising said first extension of the optical device and a second extension; the first extension engaging, at its front and rear edges, the edges of the medium during forward and rearward movements of the medium; the second extension moving into and out of an opening of the optical sensor in a manner corresponding to the rotary movements of the pivoting element brought about by the movements of the medium.

12. The hard copy device as claimed in claim 7, wherein the first extension has a flattened structure defining opposite edges.

13. The hard copy device as claimed in claim 11, wherein the centroid of the pivoting element is disposed below the line joining its two rotation pivots, bringing about a self-centring effect of the rotation pivots on the lower ends of the respective grooves.

14. The hard copy device as claimed in claim 10, wherein the grooves are shaped as arcs of circles and disposed in opposition to one another, each of them defining an upper and a lower travel limit for their respective rotation pivot.

15. The hard copy device as claimed in claim 10, wherein the geometrical centre of each of the grooves is disposed at the lower end of the opposite groove.

* * * * *

UNITED STATES PATENT AND TRADEMARK OFFICE

CERTIFICATE OF CORRECTION

PATENT NO. : 6,152,443
DATED : November 28, 2000
INVENTOR(S) : Claramunt et al.

It is certified that error appears in the above-identified patent and that said Letters Patent is hereby corrected as shown below:

Claim 8, column 5,
Lines 33 through 36, please correct to read as follows:

"The hard copy device as claimed in claim 7, which further comprises a [front] deflecting element for deflecting the media when it is output from the hardcopy device, wherein such [front] deflecting element incorporates said optical device."

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*